United States Patent [19]

Shah

[11] 4,047,866

[45] Sept. 13, 1977

[54] AUTOMATIC SELF-LUBRICATING ROTARY TABLET PRESS

[75] Inventor: Dhiren N. Shah, Indianapolis, Ind.

[73] Assignee: The Dow Chemical Company, Midland, Mich.

[21] Appl. No.: 743,899

[22] Filed: Nov. 22, 1976

[51] Int. Cl.[2] ..... B30B 11/08

[52] U.S. Cl. ..... 425/107; 425/139; 425/354; 425/DIG. 115

[58] Field of Search ..... 425/107, 139, 444

[56] References Cited

U.S. PATENT DOCUMENTS

| | | | |
|---|---|---|---|
| 2,735,380 | 2/1956 | Bowes | 425/107 |
| 2,906,214 | 9/1959 | Frank | 425/139 |
| 2,992,729 | 7/1961 | Curtius | 425/139 X |
| 3,000,331 | 9/1961 | Frank | 425/139 X |
| 3,029,752 | 4/1962 | Frank | 425/107 |
| 3,063,390 | 11/1962 | Frank | 425/139 X |
| 3,388,424 | 6/1968 | Vincent et al. | 425/444 X |
| 3,392,688 | 7/1968 | Korsch | 425/107 |
| 3,533,360 | 10/1970 | Kibbe | 425/107 X |
| 3,907,069 | 9/1975 | Pryor et al. | 425/107 X |

*Primary Examiner*—J. Howard Flint, Jr.
*Attorney, Agent, or Firm*—James W. Ambrosius

[57] ABSTRACT

A self-lubricating tablet press having a force detector for measuring the force required to eject the tablet from the die cavity connected to and activating a lubricator for lubricating the dies and punch faces when the ejection force reaches a predetermined value.

4 Claims, 2 Drawing Figures

AUTOMATIC SELF-LUBRICATING ROTARY TABLET PRESS

FIELD OF THE INVENTION

The present invention is directed to an improvement in a rotary tablet press as used to manufacture tablets by the compression of a powder containing an active drug and various excipients.

BACKGROUND OF THE INVENTION

In the manufacture of tablets, particularly for use in the pharmaceutical industry, an active drug is generally mixed with an excipient, that is an inert diluent, such as, for exaple, lactose, starch, or magnesium carbonate. The excipient not only dilutes the active drug but also improves the compressability of the drug helping to form a better tablet. Particularly in high speed tablet machines used in commercial production it has also been found necessary to add lubricants to the formulation such as, for example, magnesium stearate, calcium stearate and stearic acid. Absence of or insufficient lubricaton in a tablet formulation can lead to poor quality of the finished tablet, sticking of material onto the punch faces, and damage to the machine. However, the use of lubricants in the tablet formulation has a number of disadvantages. Most lubricants are hydrophobic and when present in a tablet tend to inhibit or slow down the disintegration and dissolution of the tablet. This in turn will affect the bio-availability of the active drug. Secondly the lubricant will often decrease the compressibility of the tablet formulation. This results in a softer tablet which is more friable. In addition, the lubricant will sometimes react chemically or physically with the active drug or excipients causing such problems as discoloration or a loss in activity of the active drug.

A method of spraying lubrication on the punches of a single station tabletting press is disclosed in U.S. Pat. No. 3,461,195. However, this method is not practical for use in commercial production on a rotary press. U.S. Pat. No. 3,042,531 discloses a method of applying lubricant to the dies and punch faces of a commercial tabletting press by first tabletting a lubricated material such as lubricated sodium chloride.

SUMMARY OF THE INVENTION

The present invention is directed to an improvement in a rotary tabletting machine which automatically applies lubricant to the die and punch faces when the force required to eject the tablet from a given die reaches a predetermined value. Thus an objective of the present invention is to provide a commercial rotary tablet press which is self-lubricating and capale of manufacturing pharmaceutical tablets from a tabletting formulation having minimal or no lubricating agent present in the material itself. Another objective of the invention is to provide a self-lubricating tabletting press which will produce pharmaceutical tablets using a minimum amount of lubricant.

The rotary tablet press which is the subject of the present invention has a force detector for measuring the force required to eject a finished tablet from each die following compression. Such instrumentation has been used and is described in the literature. *Jour. Pharm. Sci.* 56, p. 109 and p. 116 (1967) and U.s. Pat. No. 3,255,716. The ejectional force serves as an indicium of the lubrication remaining on the dies and punch faces. In accordance with the present invention, when the ejectional force reches a predetermined maximum value the force detector transmits a signal to a lubricator activating the lubricator wereby additional lubrication is applied by the lubricator by spraying or swabbing predetermined controlled amounts of lubricant onto the inside of the dies and the punch faces. This controlled useage of lubricant assures that a minimum amount of lubrication is used in the production of the tablets and the need for including lubricant in the formulation is eliminated.

A typical rotary tablet press as used by the pharmaceutical industry generally consists of a revolving head with movable multiple punches and dies that ride on a continuous cam path. Along the cam path are stations for carrying out the various tabletting operations. Although the cam path is continuous, the functional arrangement of the various stations vary and include filling the dies with tabletting material, adjusting the amount (by weight or volume) of the material fitted into the die, compressing the tabletting material to form a tablet, and ejecting the finished tablet from the die. Although the lubrication could be applied at other positions along the cam path cycle, it is most conveniently applied at an additional station located after tablet ejection and before the beginning of the next tabletting cycle.

DESCRIPTION OF THE DRAWINGS

Referring to the drawing.

DETAILED DESCRIPTION OF THE INVENTION

Figures 1, 2:
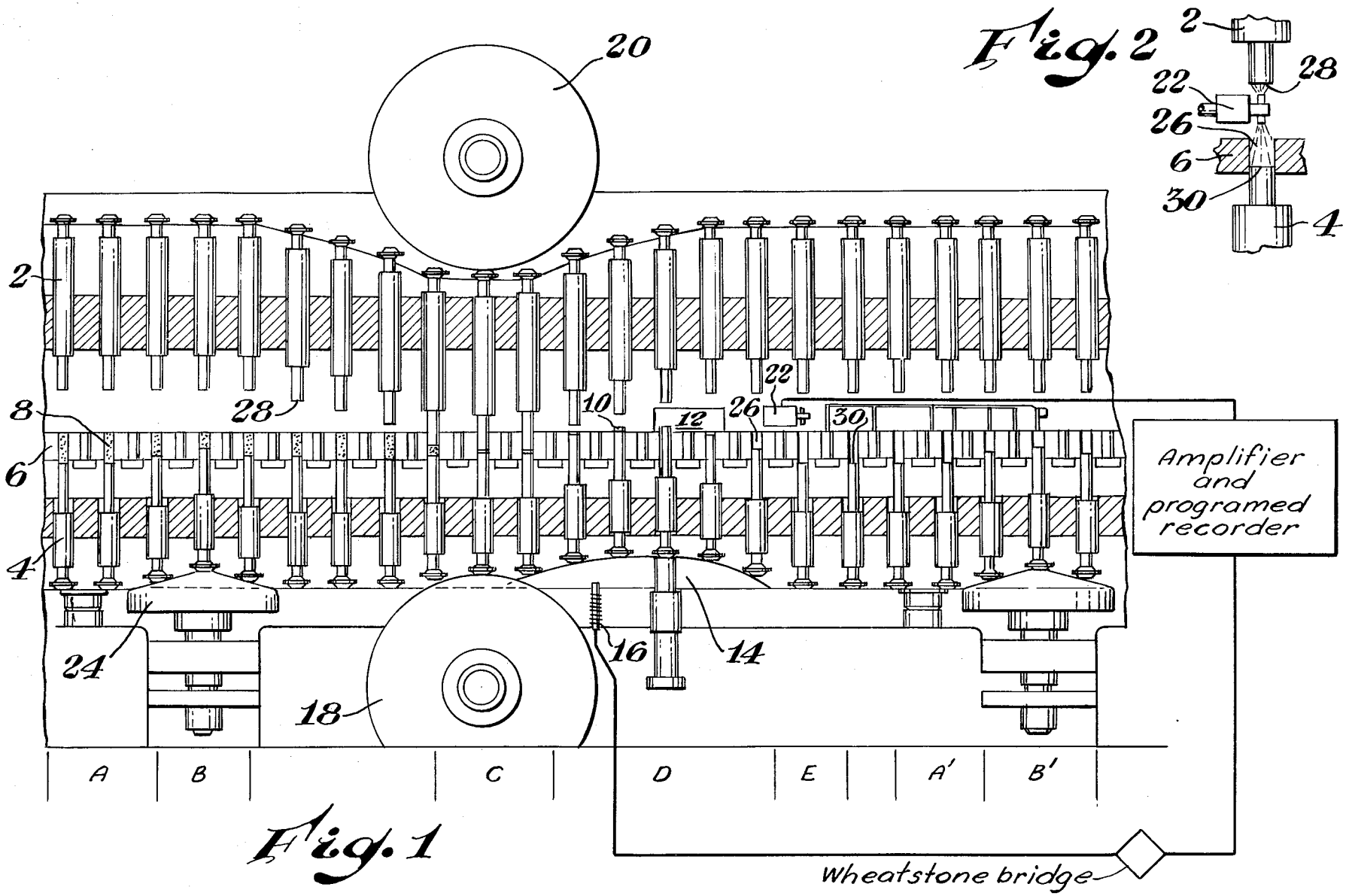
FIG. 1 is a diagramatic representation of the cam path of a segment of the improved rotary tablet press that is the subject of this invention.
FIG. 2 is an enlargement of the detail of FIG. 1 showing the spray lubricator and aligned dies and punches.

Referring to the figure, the essential features of the preferred embodiment of the invention consist of a plurality of movable upper punches 2 and movable lower punches 4 which are in direct vertical alignment with the tabletting dies 6. On the upper cam path is a upper compression roll 20. On the lower cam path are a fill adjustment shoe 24, a lower compression roll 18 and an ejection shoe 14 equipped with a foil strain gauge 16 for measuring the ejection force. Between punches 4 are an ejection guide 12 and lubrication spray apparatus 22 for spraying the die cavity 26, the upper punch faces 28, and lower punch faces 30.

The lubrication spray device 22 is connected to foil strain gauge 16 in such a manner so as to be activated when the ejection force required to eject a tablet 10 from die cavity 26 of the punch-die unit reaches a predetermined value. Upon receipt of a signal from the strain gauge indicating the predetermined force has been reached, controlled amounts of lubricant are released.

It is understood by one skilled in the art that the mechanism for actuating and controlling the lubricators can be electrical, mechanical, hydraulic or other conventional assemblies which are actuated by a signal from the strain gauge. In one embodiment of the invention (as shown in FIG. 1) the foil strain gauge is connected to a wheatstone bridge, an amplifier, and a programmed recorder. The lubrication spray device is connected to the recorder or the amplifier and programed to spray lubricant onto the punch faces and dies when the ejection force exceeds the predetermined maximum force, as, for example, 30 lbs/sq. in. The spray device would continue to apply lubricant until the ejection force drops below a certain reading, as, for example, 10 lbs./sq. in.

Generally the ejection force will have a range of from about 5 to 50 lbs./sq. in. In most rotary presses an ejection force of about 40 to 50 lbs./sq. in. is indicative of insufficient lubrication. In a well lubricated formulation the ejection force may be about 5 to 10 lbs./sq. in. One skilled in the art will realize that the ejectional force will vary somewhat with the design of the tabletting machine, wear on the punch-die units, the exact formulation being tabletted, the lubricant used, and other such factors.

In oeration, the die cavity 26 is filled with tabletting material 8 at station A. As the dies and punches move along the cam path the lower punches 4 ride up over the fill adjustment shoe 24 at station B to remove excess tabletting material from the die cavity. At station C the lower punches 4 and the upper punches 2 simultaneously ride over the lower compression roll 18 and the upper compression roll 20, respectively. The tablet 10 formed at station C is ejected from the die cavity 26 at station D as the lower punches 4 ride over the ejection shoe 14. An ejection guide 12 directs the tablet 10 into a storage hopper (not shown). The foil strain gauge 16 measures the force required to eject tablet 10 from die cavity 26. When the ejection force reaches a predetermined value indicating additional lubrication is required for continued operation, the lubricator is activated and lubricating material is automatically sprayed onto the punch faces 28 and 30 and into the die cavity 26 by the spray device 22 at station E. A complete tabletting cycle thus begins at fill station A and ends at lubricating station E, and a new cycle would begin at fill station A'. The number of cycles in a given press is dependent on the size of the unit, spacing punches and dies and unique design configuration of a given machine.

One familar with the art will recognize that the rotary tablet press described above is basically of the same design as conventionally used as except for the novel improved means for applying lubricant to the punch faces and die cavity. The lubricant can be applied as a liquid or as a dry powder. Suitable lubricants include polytetrafluoroethylene, stearic acid, glycine, magnesium stearate, calcium stearate, sodium stearate, aluminum stearate, fumaric acid, boric acid and the like. If the lubricants are applied as a liquid, they may be dissolved or suspended in a suitable solvent such as, for example methylene chloride, chloroform, or alcohol. The exact lubricant or combination of lubricants for a specific tabletting operation will depend on various factors such as the physical characteristics of the formulation, the active drug employed, the excipients present, the type and speed of the tablet press used.

I claim:

1. In a rotary tablet press having a revolving head with multiple upper punches, lower punches, and dies that ride on a cam path having stations for filling the dies with tabletting material, adjusting the amount of die fill, compressing the tabletting material to form a tablet, and ejecting the tablet, wherein the improvement comprises a force detector for measuring the force required to eject the tablet from a given die cavity, said force detector being connected to a lubricator for applying controlled amounts of lubricant to said die cavity and punch faces, said lubricator being activated as the force required to eject the tablet from the die cavity reaches a predetermined value as measured by the force detector.

2. The rotary tablet press of claim 1 wherein the lubricator is located at a lubricating station positioned in the cam path between the stations of ejecting the tablet and filling the dies with the tabletting material.

3. The press of claim 2 wherein the force detector is a foil strain guage.

4. The press of claim 3 wherein the lubricator sprays lubricant onto the punch faces and dies.

* * * * *

UNITED STATES PATENT AND TRADEMARK OFFICE

CERTIFICATE OF CORRECTION

PATENT NO. : 4,047,866
DATED : September 13, 1977
INVENTOR(S) : Dhiren N. Shah

It is certified that error appears in the above-identified patent and that said Letters Patent are hereby corrected as shown below:

Column 1, line 16, "exaple," should read --example,--.

Column 1, line 24, "lubricaton" should read --lubrication--.

Column 1, line 54, "capale" should read --capable--.

Column 1, line 66, "U.s." should read --U.S.--.

Column 2, line 2, "reches" should read --reaches--.

Column 2, line 4, "wereby" should read --whereby--.

Column 2, line 19, "fitted" should read --filled--.

Column 2, line 42, "a" should read --an--.

Column 3, line 15, "oeration," should read --operation,--.

Column 4, Claim 2, line 35, should read --filling the dies with tabletting material.--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*